US010121623B2

(12) United States Patent
Blondy et al.

(10) Patent No.: US 10,121,623 B2
(45) Date of Patent: Nov. 6, 2018

(54) ROBUST MICROELECTROMECHANICAL SWITCH

(71) Applicant: AIRMEMS, Limoges (FR)

(72) Inventors: Pierre Blondy, Limoges (FR); Romain Stefanini, Limoges (FR); Ling Yan Zhang, Limoges (FR); Abedel Halim Zahr, Limoges (FR)

(73) Assignee: AIRMEMS (FR)

( * ) Notice: Subject to any disclaimer, the term of this patent is extended or adjusted under 35 U.S.C. 154(b) by 0 days.

(21) Appl. No.: 15/520,667

(22) PCT Filed: Oct. 19, 2015

(86) PCT No.: PCT/FR2015/052802

§ 371 (c)(1),
(2) Date: Apr. 20, 2017

(87) PCT Pub. No.: WO2016/062956

PCT Pub. Date: Apr. 28, 2016

(65) Prior Publication Data

US 2017/0316907 A1 Nov. 2, 2017

(30) Foreign Application Priority Data

Oct. 21, 2014 (FR) ..... 14 60104

(51) Int. Cl.
*H01H 51/22* (2006.01)
*H01H 59/00* (2006.01)

(52) U.S. Cl.
CPC . *H01H 59/0009* (2013.01); *H01H 2059/0072* (2013.01)

(58) Field of Classification Search
CPC ..... H01H 59/00; H01H 51/22; H01H 2059/0072; B81B 3/0051; H01P 1/10
(Continued)

(56) References Cited

U.S. PATENT DOCUMENTS 5,619,061 A * 4/1997 Goldsmith ..... H01G 5/16 257/415
6,639,494 B1 * 10/2003 Bluzer ..... H01H 59/0009 200/181

(Continued)

FOREIGN PATENT DOCUMENTS

WO WO 2006/023724 A1 3/2006
WO WO 2006/023809 A1 3/2006
WO WO 2007/022500 A2 2/2007

OTHER PUBLICATIONS

International Search Report dated Feb. 8, 2016 for International application No. PCT/FR2015/052802.

(Continued)

*Primary Examiner* — Shawki S Ismail
*Assistant Examiner* — Lisa Homza
(74) *Attorney, Agent, or Firm* — Fay Sharpe LLP

(57) ABSTRACT

A microelectromechanical system switch includes a signal input line, a signal output line, a deformable conducting membrane electrically connected to the signal output line and including a contact dimple facing the signal input line, and an actuation electrode. The membrane has a planar round shape, with a radial opening in the direction of the signal input line, narrowing from the periphery towards the center of the membrane, the contact dimple being formed in the central region of the membrane, the actuation electrode has the same shape as the membrane, and the gap between the membrane, facing the actuation electrode, and the actuation electrode is an airgap only.

13 Claims, 4 Drawing Sheets

(58) Field of Classification Search
USPC ..... 335/78
See application file for complete search history.

(56) References Cited

U.S. PATENT DOCUMENTS

| | | | | |
|---|---|---|---|---|
| 6,707,355 | B1 * | 3/2004 | Yee | H01H 59/0009 200/181 |
| 7,528,691 | B2 * | 5/2009 | Wallis | H01H 59/0009 200/181 |
| 7,928,333 | B2 * | 4/2011 | Wang | H01H 59/0009 200/181 |
| 8,354,899 | B2 * | 1/2013 | Keimel | H01H 1/0036 200/181 |
| 2003/0058069 | A1 * | 3/2003 | Schwartz | H01H 59/0009 335/78 |
| 2003/0090350 | A1 * | 5/2003 | Feng | H01H 59/0009 335/78 |
| 2003/0214373 | A1 * | 11/2003 | Andricacos | H01H 59/0009 335/78 |
| 2005/0140478 | A1 * | 6/2005 | Lee | H01H 59/0009 335/78 |
| 2005/0225412 | A1 * | 10/2005 | Limcangco | H01H 59/0009 335/78 |
| 2005/0248424 | A1 * | 11/2005 | Chou | B81B 3/0072 335/78 |
| 2006/0038642 | A1 * | 2/2006 | Goins | H01H 59/0009 335/78 |
| 2006/0125579 | A1 * | 6/2006 | Baleras | H01P 1/207 333/210 |
| 2007/0040637 | A1 * | 2/2007 | Yee | H01H 59/0009 335/78 |
| 2007/0080765 | A1 * | 4/2007 | Lee | H01P 1/127 335/78 |
| 2008/0156624 | A1 | 7/2008 | Kim et al. | |
| 2010/0181631 | A1 | 7/2010 | Lacey | |
| 2012/0031744 | A1 | 2/2012 | Naito et al. | |
| 2013/0270096 | A1 * | 10/2013 | Blondy | B81B 3/0086 200/600 |

OTHER PUBLICATIONS

Written Opinion dated Feb. 8, 2016 for International application No. PCT/FR2015/052802 (with English explanation).

French Search Report dated Jul. 6, 2015 for French Application No. 1460104 (with English explanation).

Written Opinion dated Jul. 6, 2015 for French Application No. 1460104 (with English explanation.

P. Blondy et al., *Development of an All-Metal Large Contact Force Reliable RF-MEMS Relay for Space Applications,* Published in: Microwave Conference (EuMC), 2012 42nd European Proceedings; pp. 184-185; Electronic ISBN: 978-2-87487-027-9; Date of Conference: Oct. 29-Nov. 1, 2012, Netherlands.

* cited by examiner

Overall resistance of the MEMS as a function of the number of cycles

Evolution of the actuation voltage as a function of the number of cycles

ROBUST MICROELECTROMECHANICAL SWITCH

This application is the U.S. National Phase of PCT International application No. PCT/FR2015/052802 filed Oct. 19, 2015, which claims priority from French Application No. 1460104 filed Oct. 21, 2014.

FIELD

The present invention relates to the field of microelectromechanical systems (MEMS) and particularly relates to a microelectromechanical switch.

BACKGROUND

The international patent applications WO2006/023724, WO2006/023809, WO2007/022500 and WO2007/022500, as well as the US patent applications US 2012/031744 A1 and US 2010/181631 A1 describe MEMS switches according to the prior art.

The radiofrequency microelectromechanical systems (RF MEMS) allow to perform switching operations for applications covering a large range of frequencies (DC-100 GHz). Their competitive advantage in terms of performance and of low power consumption with respect to their size make them a very appreciated component by the system manufacturers.

However, in order to incorporate these components into the electronic systems, they have to provide some mechanical and thermal stability.

For example, an extended actuation of the component should not generate a permanent deformation of the mechanical membrane, which could lead to an irreversible failure.

Also, a repeated actuation should not accelerate the wear of the contact areas and lead to a degradation of the performance or to an immobilization of the component caused by a "sticking" contact.

Finally, the high temperatures experienced during the packaging or the PCB bonding phases should not generate deformations which would permanently modify the mechanical and electrical characteristics.

SUMMARY

The present invention relates to a robust microelectromechanical switch, the structure of which ensures a reduced temperature sensitivity and allows a stable electrical contact with limited sticking phenomena, while ensuring the performance inherent to the RF MEMS technology.

The present invention thus relates to a microelectromechanical (MEMS) switch, comprising:

a substrate, a signal input line formed on the substrate, a signal output line formed on the substrate, a deformable conducting membrane electrically connected to the signal output line, said deformable conducting membrane being suspended into a plane parallel to that of the substrate by anchors arranged on the substrate, said deformable conducting membrane comprising a contact dimple facing the signal input line such that, in a non-deformed state of the deformable conducting membrane, the contact dimple is not in contact with the signal input line and, in a deformed state of the deformable conducting membrane, said contact dimple is in contact with the signal input line for transmitting a signal from the signal input line to the signal output line, an actuation electrode formed on the substrate below the deformable conducting membrane, said actuation electrode being intended to deform said deformable conducting membrane for making an electrical contact between the contact dimple of the deformable conducting membrane and the signal input line, characterized in that:

the deformable conducting membrane has a planar round shape, the anchors being arranged at its periphery so as to concentrate a lower stiffness in the central region of the deformable conducting membrane, with a radial opening forming an acute angle in the direction of the signal input line, narrowing from the periphery towards the center of the deformable conducting membrane, the contact dimple being formed in the central region of the deformable conducting membrane such that the end of the signal input line is opposite the contact dimple, the actuation electrode has the same shape as the deformable conducting membrane, surrounding on the substrate the end of the signal input line, and the gap between the lower surface of the deformable conducting membrane, facing the actuation electrode, and the actuation electrode is an airgap only.

The end of the signal input line opposite the contact dimple means that the signal input line slightly extends below the deformable conducting membrane, beyond the contact dimple such that the contact dimple can come into contact with the signal input line when the deformable conducting membrane is being deformed.

The actuation electrode and the deformable conducting membrane having the same shape or substantially the same shape means that the projection of the shape of the deformable conducting membrane into the plane of the substrate is identical or nearly-identical to that of the actuation electrode, with additional adjustments due to the fact that the actuation electrode should not come into contact with the anchors or the signal input line.

The acute radial opening formed within the deformable conducting membrane allows to have a minimum of the surface of the signal input line facing the deformable conducting membrane, allowing to reduce the electrical capacity between the signal input line and the deformable conducting membrane, thereby ensuring a good isolation of the switch. The acute angle can, for example, be between 5° and 135°, preferably 50°, without these values being intended as limiting. The deformable conducting membrane thus has the shape of a circular diagram with an acute sector representing the radial opening and a complementary sector representing the deformable conducting membrane.

The fact that the actuation electrode and the deformable conducting membrane have substantially the same shape and are arranged above each other allows to generate a maximum attraction force. Furthermore, the contact area "contact dimple/signal input line" is surrounded by the actuation electrode due to the radial opening, allowing to generate a high localized contact force and ensuring the stability of the contact resistance upon actuation.

The shape of the deformable conducting membrane and its thickness with respect to the maximum displacement limit the permanent deformations thereof and ensure a better thermal stability.

The absence of dielectric between the lower surface of the deformable conducting membrane and the actuation electrode reduces the charging phenomena, facilitates the manufacture of the microelectromechanical switch according to the invention, and decreases its cost.

Due to the single radial opening formed within the deformable conducting membrane of the switch according to the invention, the surface surrounding the contact dimple in front of the signal input line is larger and thus the surface attracted by the actuation electrode is larger. This particularity imparts a higher actuation force and ensures a better stability of the electrical contact upon actuation of the switch.

According to an embodiment, an anchor is formed in the median axis of the radial opening.

According to an embodiment, two anchors are formed symmetrically with respect to the median axis of the radial opening, on a circle having the same center as the circumcircle of the deformable conducting membrane, the angle formed on the circle having the same center as the circumcircle of the deformable conducting membrane between each anchor and the median axis of the radial opening being not higher than 30°.

According to an embodiment, the others anchors are formed symmetrically with respect to this median axis. This alignment allows to concentrate the mechanically-weakest area proximate to the contact dimple.

According to an embodiment, at least one cutout is formed on the deformable conducting membrane between two diametrically-opposed anchors on a circle having the same center as the circumcircle of the deformable conducting membrane.

The one or more cutouts allow to cushion the high-temperature deflection of the component during packaging, for example, but also to reduce the actuation voltage of the component.

According to an embodiment, a cutout is formed on the deformable conducting membrane proximate to each anchor, the cutouts being formed on the perimeter of a circle having the same center as the circumcircle of the deformable conducting membrane and, preferably, having a radius lower than at least the width of the cutout.

The one or more cutouts can pass through the thickness of the deformable conducting membrane.

According to an embodiment, the contact dimple is slightly off-centered with respect to the weakest mechanical part of the deformable conducting membrane (namely, at a distance from the center of the deformable conducting membrane lower than 30% of the radius of the deformable conducting membrane). This slightly off-centered position of the contact dimple limits the sticking phenomena.

According to an embodiment, through holes are formed on a circle having the same center as the circumcircle of the deformable conducting membrane.

The one or more through holes pass through the thickness of the deformable conducting membrane and enhance the release process during the manufacturing step, without modifying the electrical and mechanical properties of the component.

According to an embodiment, one or more stoppers are formed on the lower surface of the deformable conducting membrane, each stopper facing a metal island electrically isolated from the actuation electrode.

The stoppers allow to limit the deformation of the deformable conducting membrane and ensure an electrical isolation between the deformable conducting membrane and the actuation electrode, ensuring a higher durability of the component, and also preventing the sticking of the deformable conducting membrane on the actuation electrode.

According to an embodiment, the contact dimple and, when appropriate, the stoppers are made of metal belonging to the platinum group or their oxides or both.

The use of a metal belonging to the platinum group allows to provide a contact dimple and, when appropriate, stoppers, with a high hardness, capable to withstand the mechanical impacts due to the switch closure. Also, they ensure a better temperature stability of the microelectromechanical switch of the invention, for example when passing high currents into the contact dimple.

According to an embodiment, the deformable conducting membrane is a multilayer associating dielectric layers and metal layers.

According to an embodiment, the deformable conducting membrane is made of gold, or is a metal alloy or a set of layers comprising at least one conductor.

According to an embodiment, the actuation electrode is made of gold or any other conducting or semi-conducting material.

BRIEF DESCRIPTION OF DRAWINGS

In order to better illustrate the object of the present invention, a particular embodiment will be described below, for illustrative and non-limiting purposes, in reference to the appended drawings.

In these drawings.

DETAILED DESCRIPTION

Figure 1:
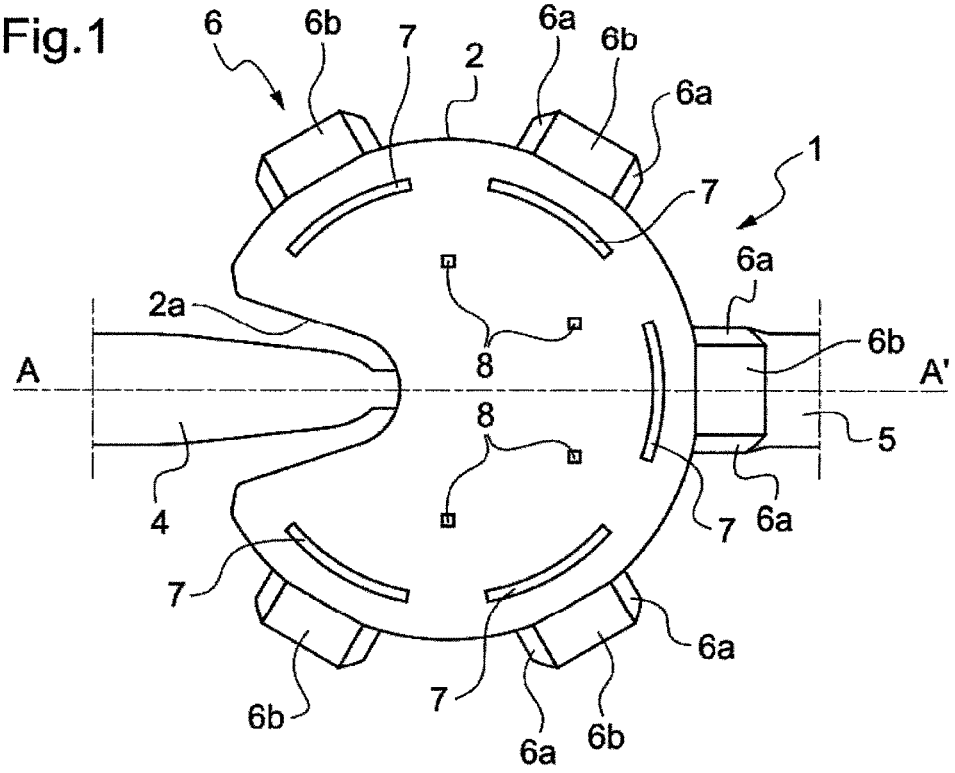
FIG. 1 is a top view of a microelectromechanical switch according to a particular embodiment of the present invention, the actuation electrode being shown in dotted lines.

If referring to FIGS. 1 to 4, it can be noted that a microelectromechanical (MEMS) switch 1 according to the invention is shown.

The microelectromechanical switch 1 is formed on a substrate S and mainly comprises a deformable conducting membrane 2, an actuation electrode 3, a signal input line 4 and a signal output line 5.

The signal input line 4, the signal output line 5 and the actuation electrode are formed on the substrate S.

The deformable conducting membrane 2 is planar, generally round-shaped, with a radial opening 2*a* in the direction of the signal input line 4, narrowing from the periphery towards the center of the deformable conducting membrane 2. The deformable conducting membrane 2 is suspended above the actuation electrode 3, by means of anchors 6, distributed at its periphery, so as to concentrate the lowest stiffness area of the deformable conducting membrane 2 at the contact dimple with the signal input line 4 (described below) arranged at a distance from the top of the radial opening lower than 30% of the radius of the deformable conducting membrane 2.

One of the anchors 6 is arranged in the direction of the signal input line 4, and allows to provide an electrical connection between the deformable conducting membrane 2 and the signal output line 5.

The other anchors 6 are distributed by pairs, opposed with respect to the center of the circumcircle of the deformable conducting membrane 2. It can be noted that, although the embodiment shown comprises five anchors 6, the invention is not limited in this respect within the scope of the present invention.

According to a preferred embodiment, the number of anchors is odd, one of the anchors 6 thus being arranged on the median axis of the radial opening 2*a*, in the direction of the signal input line 4.

Each anchor 6 is constituted by a tether extending perpendicularly to the surface of the deformable conducting membrane 2, towards the substrate S, said tether extending along two tabs 6*a*, enclosing a block 6*b* integral with the substrate S, both tabs 6*a* being suspended into the same plane as the deformable conducting membrane 2, ensuring an optimum distribution of the stresses when the temperature raises.

Cutouts 7 are formed on the deformable conducting membrane 2, in front of each anchor 6, the cutouts 7 being aligned on a circle having the same center as the circumcircle of the deformable conducting membrane 2.

Finally, holes 8 are formed on a smaller circle, having the same center as the circumcircle of the deformable conducting membrane 2. These holes are optional within the scope of the invention.

Figure 2:
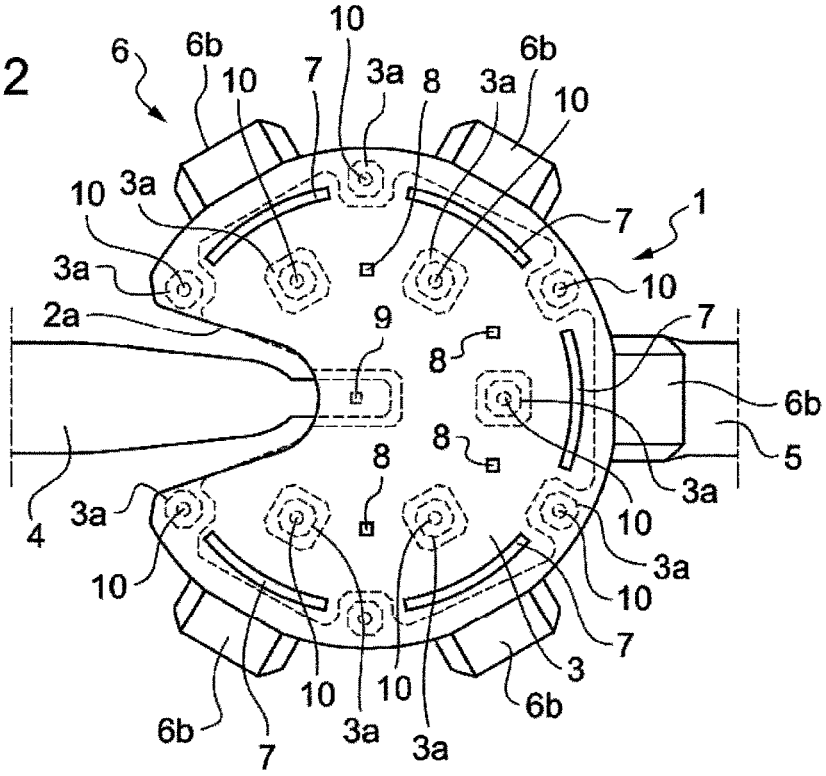
FIG. 2 is a view similar to FIG. 1, with the elements arranged below the deformable conducting membrane being shown in dotted lines.

If referring more particularly to FIG. 2, it can be noted that the lower surface of the deformable conducting membrane 2, facing the actuation electrode 3, carries a contact dimple 9, proximate to the top of the radial opening 2*a*, intended, under the deformation of the deformable conducting membrane 2 by the actuation electrode 3, to come into contact with the end of the signal input line 4.

Stoppers 10, substantially formed on the same circles as the holes 8 and the cutouts 7, are formed on the lower surface of the deformable conducting membrane 2, their function being described in more detail below.

The actuation electrode 3 has substantially the same shape as the deformable conducting membrane 2, and surrounds the end of the signal input line 4.

If referring to FIG. 2, it can be noted that islands 3*a*, electrically isolated from the rest of the actuation electrode, are formed opposite the stoppers 10.

The function of the stoppers 10 and islands 3*a* consists in allowing, during the deformation of the deformable conducting membrane 2 attracted by the actuation electrode, to limit the deformation of the deformable conducting membrane 2 by contact of the stoppers 10 on the islands 3*a*. Although the presence of the islands 3*a* and stoppers 10 is preferred, since it limits the deformation of the deformable conducting membrane 2 and allows the electrical isolation thereof, a switch which does not comprise them is also within the scope of the present invention, which is not limited in this respect.

The substantially identical shapes of the deformable conducting membrane 2 and the actuation electrode 3 allow to ensure an uniform and homogeneous deformation while ensuring the generation of a high electrostatic force.

The overall shape of the microelectromechanical switch 1 according to the invention, which is round with an opening 2*a* on the signal input line 4, allows to ensure a high contact force, localized at the center of the circle due to the position of the anchors and the shape of the membrane, thereby ensuring an electrically stable contact with the end of the signal input line 4.

The opening 2*a* also allows to limit the surface of the deformable conducting membrane 2 facing the current input line 4, reducing the electrical couplings therebetween.

Figure 3:
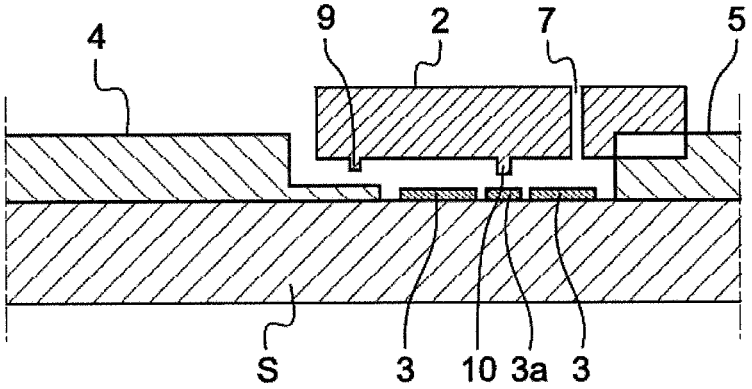
FIG. 3 is a cross-sectional view of the switch of FIG. 1 along the line A-A', in its open position.
Figure 4:
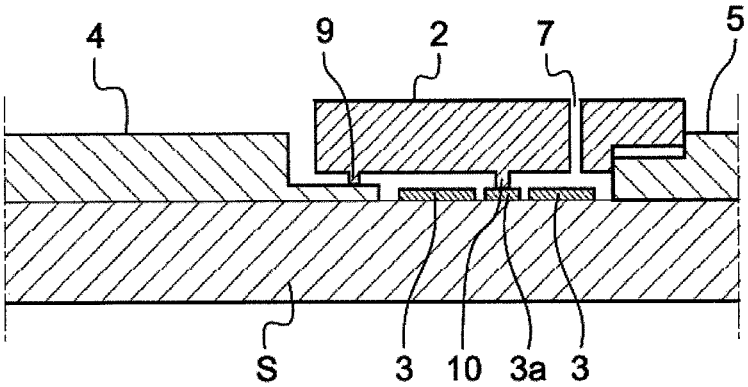
FIG. 4 is a cross-sectional view of the switch of FIG. 1 along the line A-A', in its actuated position.

FIGS. 3 and 4 illustrate the two open and closed positions, respectively, of the microelectromechanical switch 1 according to the invention.

In FIG. 3, it can be noted that an airgap between the deformable conducting membrane 2 and the actuation electrode 3 is provided. The microelectromechanical switch 1 is open, and the signal does not pass between the signal input line 4 and the signal output line 5.

In FIG. 4, it can be noted that the contact dimple 9 is in contact with the end of the signal input line 4, the stoppers 10 being in contact with the islands 3*a*. The microelectromechanical switch 1 is closed, and the signal passes between the signal input line 4 and the signal output line 5.

Figure 5:
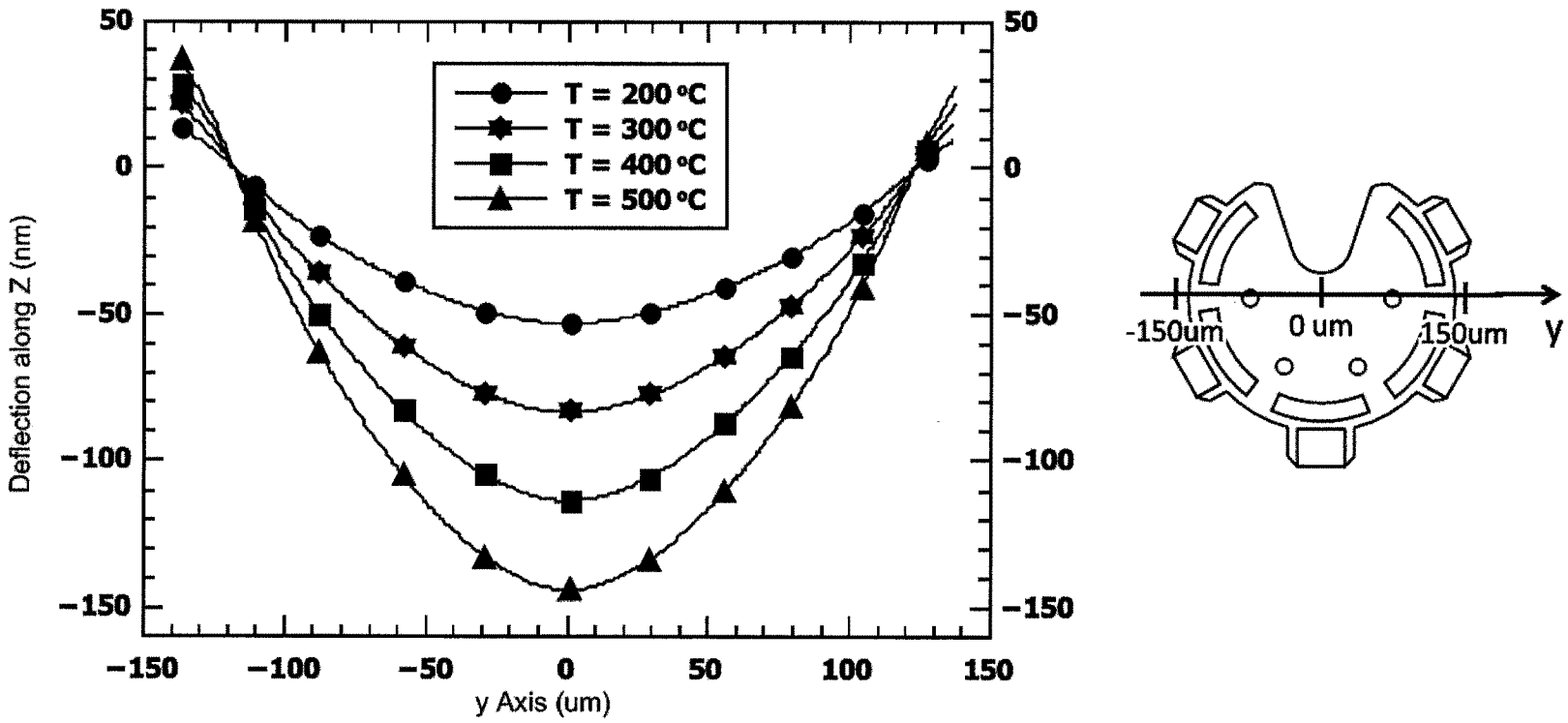
FIG. 5 is a simulation of the deflection of the membrane of the switch of FIG. 1 for different temperatures, along the axis y indicated on the detailed view, the simulated membrane being made of gold.

In FIG. 5, it can be noted that the deflection of the membrane according to the invention is low (<0.15 μm) when subjected to high temperature stresses (500° C.)

Figure 6:
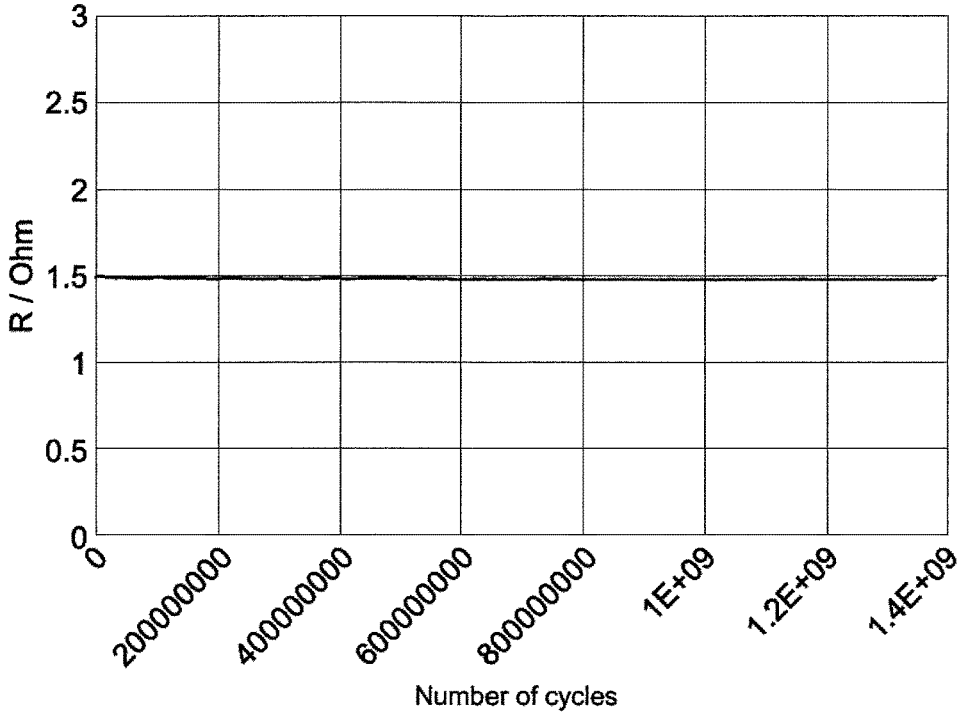
FIG. 6 is the measurement of the evolution of the contact resistance of the switch of FIG. 1 as a function of the number of cycles, a cycle being defined as the succession of an actuation action (passing state or down-state) and an opening action (isolation state or up-state) of the switch, the switch being cycled at a frequency of 4 kHz.

In FIG. 6, one can note the stability of the contact resistance due to the high localized contact force generated by the present invention, during more than one billion of actuations.

Figure 7:
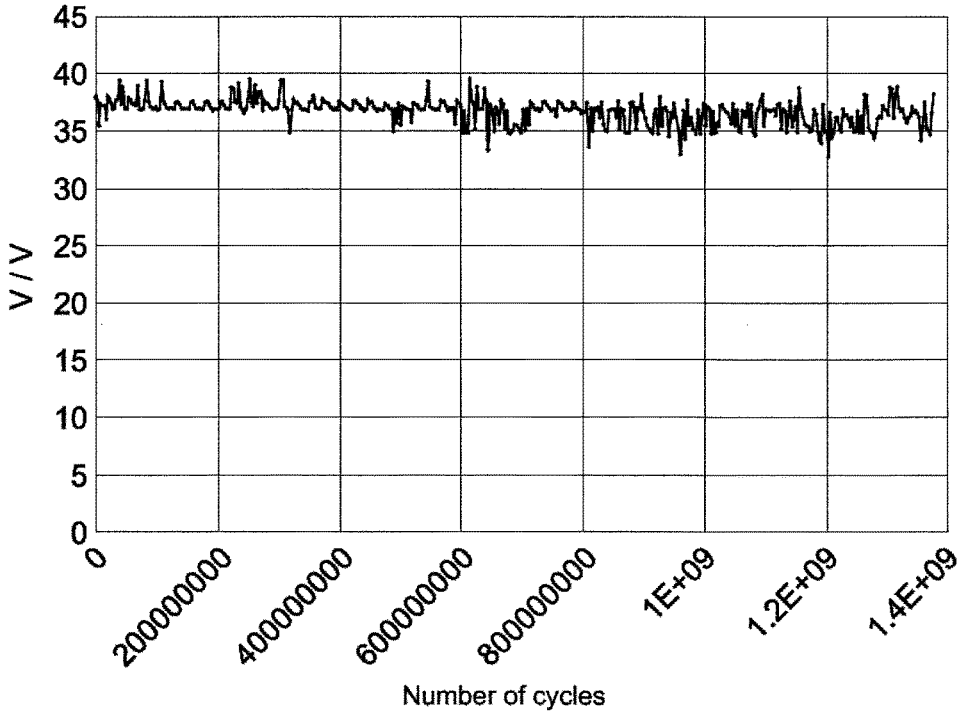
FIG. 7 is the measurement of the evolution of the actuation voltage of the switch of FIG. 1 as a function of the number of cycles, at a frequency of 4 kHz.

In FIG. 7, one can note the stability of the actuation voltage due to the homogeneous deformation and the airgap allowed by the invention.

The substrate is advantageously silicon. The actuation electrode is advantageously made of gold, but can also be made of any other conducting or semi-conducting material.

The deformable conducting membrane 2 is advantageously made of gold, but can also be a metal alloy or a set of layers comprising at least one conductor.

The contact dimple 9 and the stoppers 10 are integrally formed with the deformable conducting membrane 2. They can advantageously be covered with a harder material so as to increase their resistance.

As a non-limiting example, a switch according to the invention is contained in a circle having a radius of 140 μm.

In an embodiment, the thickness of the switch is 7 μm, its lowering voltage is 55V, its return force is 1.8 mN and its contact force is between 2 and 4 mN at 70V.

The invention claimed is:

1. A microelectromechanical (MEMS) switch, comprising:

a substrate, a signal input line formed on the substrate, a signal output line formed on the substrate, a deformable conducting membrane, electrically connected to the signal output line, the deformable conducting membrane being suspended into a plane parallel to the plane of the substrate by anchors arranged on the substrate, the deformable conducting membrane comprising a contact dimple facing the signal input line such that, in a non-deformed state of the deformable conducting membrane, the contact dimple is not in contact with the signal input line and, in a deformed state of the deformable conducting membrane, the contact dimple is in contact with the signal input line for transmitting a signal from the signal input line to the signal output line, an actuation electrode formed on the substrate below the deformable conducting membrane, the actuation electrode being intended to deform the deformable conducting membrane for making an electrical contact between the contact dimple of the deformable conducting membrane and the signal input line, wherein:

the deformable conducting membrane comprises a planar round shape, the anchors being arranged at its periphery so as to concentrate a lower stiffness in the central region of the deformable conducting membrane, with a radial opening forming an acute angle in the direction of the signal input line narrowing from the periphery towards the center of the deformable conducting membrane, the contact dimple being formed in the central region of the deformable conducting membrane such that the end of the signal input line is opposite the contact dimple, the actuation electrode comprises the same shape as the deformable conducting membrane, surrounding on the substrate the end of the signal input line, and the gap between the lower surface of the deformable conducting membrane, facing the actuation electrode, and the actuation electrode is an airgap only.

2. The microelectromechanical switch according to claim 1, wherein an anchor is formed in the median axis of the radial opening.

3. The microelectromechanical switch according to claim 1, wherein two anchors are formed symmetrically with respect to the median axis of the radial opening, on a circle having the same center as the circumcircle of the deformable conducting membrane, the angle formed on the circle having the same center as the circumcircle of the deformable conducting membrane between each anchor and the median axis of the radial opening being not higher than 30°.

4. The microelectromechanical switch according to claim 1, wherein the other anchors are formed symmetrically with respect to the median axis of the radial opening.

5. The microelectromechanical switch according to claim 1, wherein at least one cutout is formed on the deformable conducting membrane between two diametrically-opposed anchors on a circle having the same center as the circumcircle of the deformable conducting membrane.

6. The microelectromechanical switch according to claim 1, wherein a cutout is formed on the deformable conducting membrane proximate to each anchor, the cutouts being formed on the perimeter of a circle having the same center as the circumcircle of the deformable conducting membrane.

7. The microelectromechanical switch according to claim 6, wherein the one or more cutouts pass through the thickness of the deformable conducting membrane.

8. The microelectromechanical switch according to claim 1, wherein through holes are formed on a circle having the same center as the circumcircle of the deformable conducting membrane.

9. The microelectromechanical switch according to claim 1, wherein one or more stoppers are formed on the lower surface of the deformable conducting membrane, each stopper facing a metal island electrically isolated from the actuation electrode.

10. The microelectromechanical switch according to claim 1, wherein the contact dimple is made of metal belonging to the platinum group or their oxides or both.

11. The microelectromechanical switch according to claim 1, wherein the deformable conducting membrane is made of gold, or is a metal alloy or a set of layers comprising at least one conductor.

12. The microelectromechanical switch according to claim 1, wherein the actuation electrode is made of gold or any other conducting or semi-conducting material.

13. The microelectromechanical switch according to claim 1, wherein the stoppers are made of metal belonging to the platinum group or their oxides or both.

* * * * *